US007104527B2

(12) United States Patent
Koizumi

(10) Patent No.: US 7,104,527 B2
(45) Date of Patent: Sep. 12, 2006

(54) CARBURETOR WITH MANUAL CHOKE MECHANISM

(75) Inventor: Kimio Koizumi, Iwate-ken (JP)

(73) Assignee: Z AMA Japan Co., Ltd., Iwate-Ken (JP)

( * ) Notice: Subject to any disclaimer, the term of this patent is extended or adjusted under 35 U.S.C. 154(b) by 18 days.

(21) Appl. No.: 10/992,813

(22) Filed: Nov. 22, 2004

(65) Prior Publication Data

US 2005/0116363 A1 Jun. 2, 2005

(30) Foreign Application Priority Data

Nov. 27, 2003 (JP) ..... 2003-397006

(51) Int. Cl.
*F02M 1/02* (2006.01)

(52) U.S. Cl. ..... 261/52; 261/64.1; 261/65

(58) Field of Classification Search ..... 261/52, 261/64.1, 65

See application file for complete search history.

(56) References Cited

U.S. PATENT DOCUMENTS 2,340,736 A * 2/1944 Coffey ..... 261/34.2
4,141,940 A * 2/1979 Dye ..... 261/23.2
4,307,042 A * 12/1981 Berich ..... 261/52
4,323,521 A * 4/1982 Morgenroth ..... 261/50.2
6,202,989 B1 * 3/2001 Pattullo ..... 261/52
6,454,245 B1 * 9/2002 Kobayashi ..... 261/52
6,896,245 B1 * 5/2005 Suzuki et al. ..... 261/23.2
2001/0013664 A1 * 8/2001 Kobayashi ..... 261/52

FOREIGN PATENT DOCUMENTS

JP 54-123636 * 9/1979 ..... 261/52

* cited by examiner

*Primary Examiner*—Richard L. Chiesa
(74) *Attorney, Agent, or Firm*—Baker Botts L.L.P.

(57) ABSTRACT

A choke valve is fixed to a predetermined position even after manual release, whereby an improved start and a subsequent stable operation are obtained. A fixing force and a valve opening force are applied to a choke valve shaft. Further, a pin of a choke valve lever pushes an arm piece of a throttle valve lever to slightly open a throttle valve when a choke valve is in a fully open position, and the choke valve opens half way to return the throttle valve to an idle position by a valve closing spring when a complete firing of the engine is achieved. When opening the throttle valve, a cam of the throttle valve lever pushes the pin to open the choke valve, a valve opening force overcomes a fixing force near the fully open position to set the choke valve to the fully open position, and the pin separates from the cam to open and close the throttle valve without interference with the choke valve. The fixing force overcomes the valve opening force from the fully close position to a position proximate to the fully open position, and the choke valve is fixed even after manual release.

3 Claims, 8 Drawing Sheets

CARBURETOR WITH MANUAL CHOKE MECHANISM

BACKGROUND OF THE INVENTION

This application claims the benefit of Japanese Patent Application No. 2003-397006, filed Nov. 27, 2003.

1. Field of the Invention

The present invention relates to a carburetor for supplying fuel to a general-purpose, internal combustion engine used as a power source of a portable operating machine or the like, and more particularly, to a carburetor with a manual choke mechanism.

2. Description of Related Art

It is known to improve an engine's starting properties when temperatures are low, by placing a choke valve in an inlet of an intake passage of a carburetor and opening a throttle valve slightly from an idle position, as well as fully closing the choke valve. The carburetor for the general-purpose, internal combustion engine employs a manual choke mechanism which may be placed in a confined space and fabricated at a low cost with a reduced number of parts.

The choke valve in known manual choke mechanisms is of a fixed type, in which the choke valve is mounted to a choke valve shaft crossing a center axis of the intake passage, and is started by the delicate operation of changing the choke valve from a full close state to a full open state by the manual operation of the choke valve by the driver, and changing the throttle valve at an appropriate time by operation of the throttle valve by the driver. Accordingly, for example, as described in Japanese Utility Model Publication No. 35-4305, Japanese Unexamined Patent Publication No. 49-109738 and "Theory and Practice of Carburetor" written by Takashi Yoshida, issued by Railroad Japan Company, in 1980, it is possible to employ a semiautomatic choke mechanism structured, such that the choke valve and the throttle valve are interlocked by a link mechanism to the manual choke mechanism, and the throttle valve is opened slightly from the idle position when the choke valve is fully closed. In this case, it is possible to start the engine without this delicate operation.

However, when fully closing the choke valve by manual operation prior to the manual choke mechanism, the operating force may be applied at least until the engine is completely fired. In particular, in the manual choke mechanism, to which the semiautomatic choke mechanism is applied, there is a danger that the choke valve and the throttle valve may become unstable by releasing either or both of the valves immediately when the valves are fully closed, whereby it may be impossible to securely hold the choke and throttle valves at their respective fully closed position and slightly open position, so as to securely start the engine.

SUMMARY OF THE INVENTION

The present invention solves the problem described above. When the choke valve is of the fixed type and the link mechanism for working the throttle valve with the choke valve is configured, such that the throttle valve is set to the position slightly open from the idle position at the fully closed position of the choke valve, and is applied to the manual choke mechanism, it may be difficult to securely hold the valves at the respective fully closed position of the choke valve and the slightly open position of the throttle valve so as to securely start the engine even after releasing either or both valves. An object of the present invention is to provide a structure in which the choke valve is fixed at whatever position it is in when released during manual operation from the fully closed position to the fully opened position, the throttle valve is securely held at the slightly open position when the choke valve is at the fully closed position. The choke valve is opened in association with the opening operation of the throttle valve even if the choke valve is fixed to the half-open state, and the choke valve is not interfered with by the opening and closing of the throttle valve when the choke valve is fully opened.

In order to solve the problem described above, the carburetor of the present invention comprises a manual choke mechanism comprising a return spring adapted to open a fixed type choke valve, a pressing member adapted to fix the choke valve, a valve closing spring adapted to close a throttle valve, and a choke valve lever secured to a choke valve shaft and a throttle valve lever secured to a throttle valve shaft.

The return spring and the pressing member are structured, such that the return spring overcomes a fixing force of the pressing member so as to open the choke valve from a position proximate to a fully open position to the fully open position, and the pressing member overcomes a spring force of the return spring so as to fix the choke valve at another position. Further, the choke valve lever and the throttle valve lever are structured, such that the throttle valve is set to a position slightly open from an idle position when the choke valve is fully closed, the throttle valve is set to the idle position due to the spring force of the valve closing spring when the choke valve is opened from a fully closed position, the choke valve is opened from a half-open state proximate to the fully opened position when the throttle valve is opened from the idle position to the fully opened position, and the opening and closing of the throttle valve occurs with no mutual interference when the choke valve is fully opened.

When fully closing the choke valve by manual operation for starting the engine, the throttle valve is slightly opened from the idle position, and when the engine is completely fired in this condition, the throttle valve is at the idle position by opening the choke valve, for example, to a half-open position so as to continue a warm-up operation and an idling operation. Next, when opening the throttle valve by an accelerator operation for executing a normal operation, the choke valve is fully opened by the return spring when opening the choke valve approaches the fully open position while the throttle valve is reaching the fully open position when the choke valve is half open, whereby the link between the choke valve lever and the throttle valve lever is disconnected, and the throttle valve reaches the fully open position by accelerator operation. Because the choke valve is fixed by the pressing member, except the position proximate to the fully open position, the choke valve is held securely at a predetermined position even after manual release, and is opened to the fully open position by accelerator operation and the return spring, except when the choke valve is fully closed before starting and when the choke valve is appropriately opened after the complete firing of the engine, so that the operation may be carried out without difficulty. Further, because the choke valve lever and the throttle valve lever are not linked when the choke valve is fully open, normal control by accelerator operation may be executed without difficulty.

In accordance with the present invention, a manual choke mechanism is provided having an uncomplicated structure and operability, in which the choke valve is fixed to the predetermined position and an improved start may be achieved, even after manual release.

Other objects, features, and advantages will be apparent to those of ordinary skill in the relevant art in view of the following detailed description of preferred embodiments and the accompanying drawings.

DETAILED DESCRIPTION OF PREFERRED EMBODIMENTS

Figure 1A:
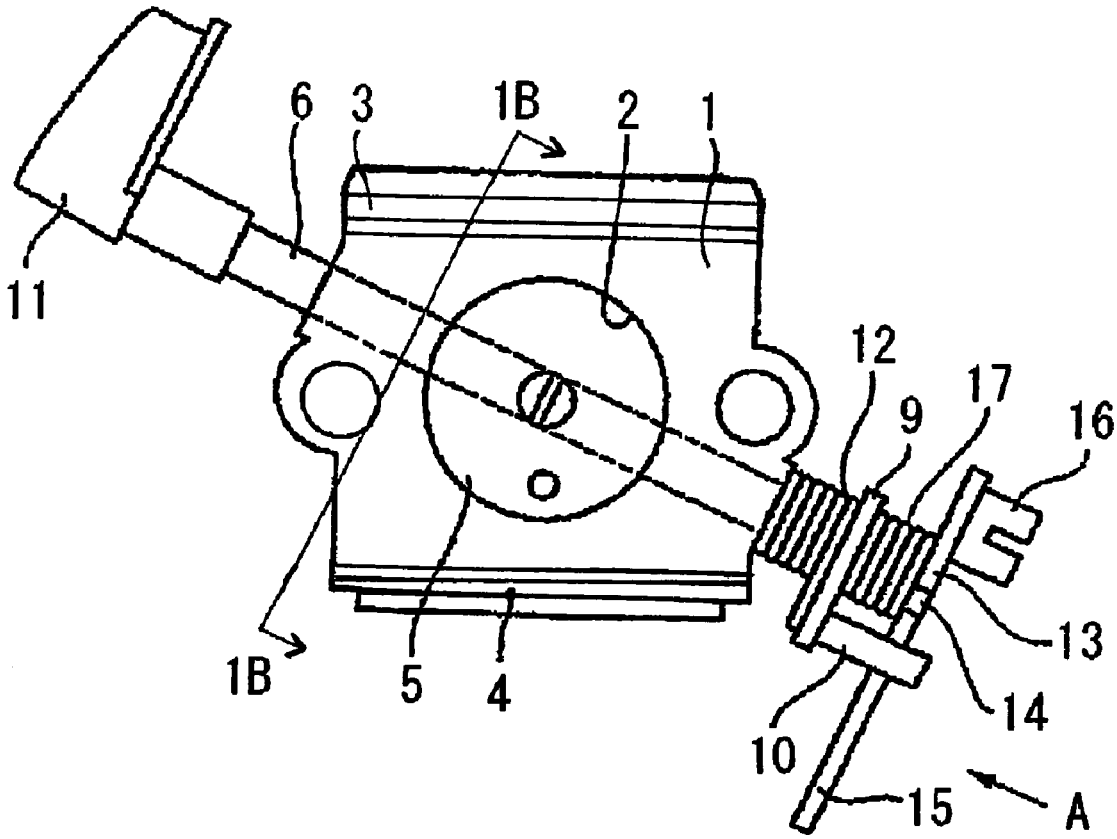
FIG. 1A is a side view showing an embodiment in accordance with the present invention.

An embodiment in accordance with the present invention is described with reference to the accompanying drawings. Referring to FIGS. 1A and 1C, a fuel pump 3 is disposed on an upper surface of a carburetor main body 1 comprising an intake passage 2 extending in a horizontal direction, and a diaphragm-type fuel metering portion 4 is disposed on a lower surface. Fuel pump 3 is operated on the basis of a pulse pressure generated in a crank case of an engine to feed fuel in a fuel tank to fuel metering portion 4, and fuel metering portion 4 stores a fixed amount of fuel and feeds that fuel to intake passage 2.

Figure 2:
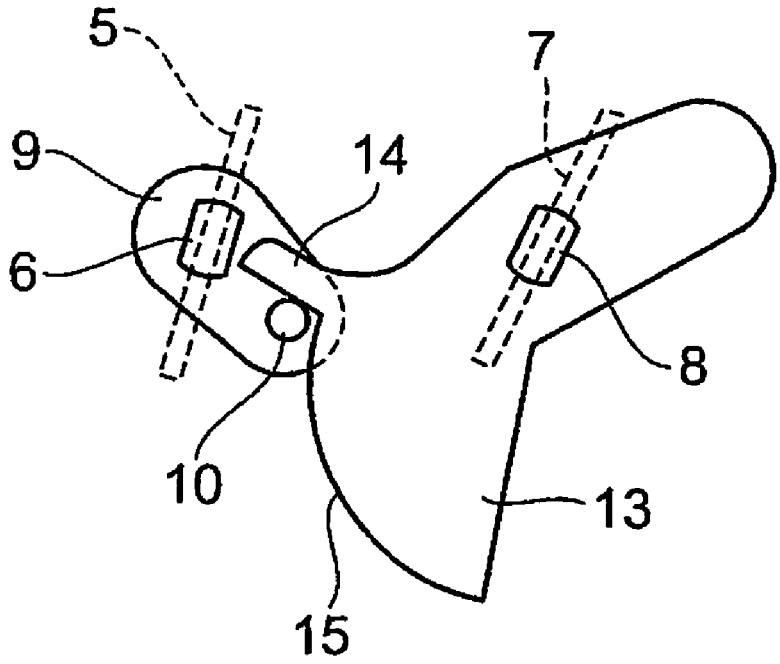
FIG. 2 is a front view of a link mechanism before starting, as seen in a direction of an arrow A in FIG. 1.

Referring to FIG. 2, a choke valve 5 and a throttle valve 7 are disposed in an inlet and an outlet of intake passage 2, are formed in a disc shape, and are mounted respectively to a choke valve shaft 6 and a throttle valve shaft 8, which are supported in parallel to each other and are rotatable with each other across a center axis of intake passage 2. Accordingly, choke valve 5 is of a fixed type, which is not opened by an eccentric moment caused by an intake air flow.

A choke valve lever 9 is securely fixed to one end of choke valve shaft 6, and a knob 11 for manual operation is securely fixed to one end on an opposite side. A return spring 12 comprising a torsion coil spring, in which one end is fixed to carburetor main body 1 and another end is engaged with choke valve lever 9 and which works in a valve opening direction, is wound around choke valve shaft 6. Further, a throttle valve lever 13 is securely fixed to one end of throttle valve shaft 8, and a valve closing spring 17 comprising a torsion coil spring, in which one end is fixed to carburetor main body 1 and another end is engaged with throttle valve lever 13 and which works in a valve closing direction, is wound around throttle valve shaft 8.

Figure 1B:
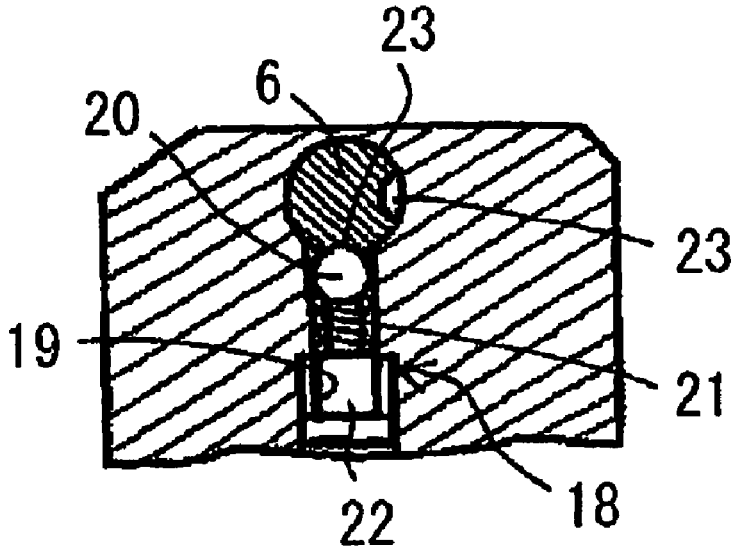
FIG. 1B is an enlarged cross-section of the embodiment shown in FIG. 1A, along line 1B—1B.
Figure 1C:
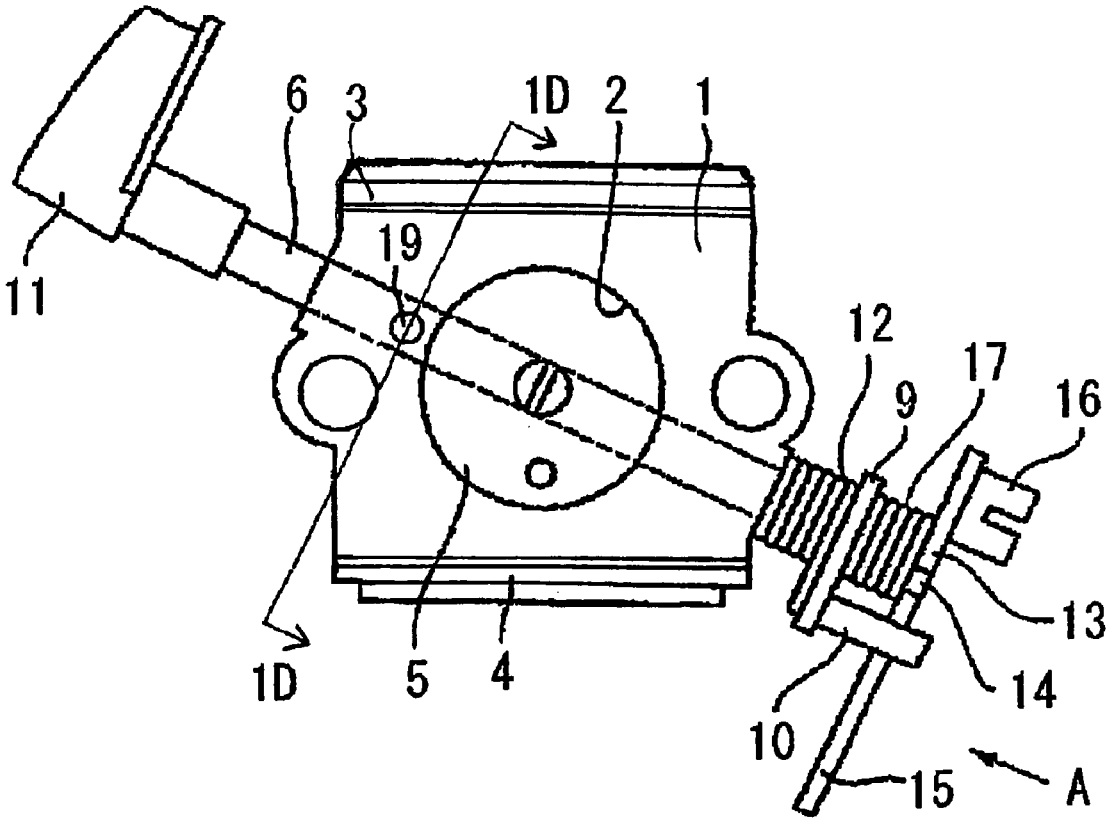
FIG. 1C is a side view showing another embodiment in accordance with the present invention.

On the other hand, referring to FIG. 1B, a pressing device comprising a pressing member 18, which comprises a ball 20 and a spring 21 pressing ball 20 to choke valve shaft 6, is inserted in a mounting hole 19 formed in carburetor main body 1 and positioned orthogonal to choke valve shaft 6. These components are secured in mounting hole 19 by a screw cap 22, and pressing member 18 comprises these elements. A peripheral groove 23 is formed in choke valve shaft 6, and a portion of ball 20 is fitted in linear contact with groove 23. Further, choke valve lever 9 comprises a pin 10 which protrudes from choke valve lever 9 and is perpendicular to the lever's surface. Throttle valve lever 13 comprises an arm piece 14, which protrudes from throttle valve lever 13 on that lever's surface; a cam 15, which is formed in an outer edge thereof, and a post 16, which connects to an accelerator wire mounted thereto.

Figure 1D:
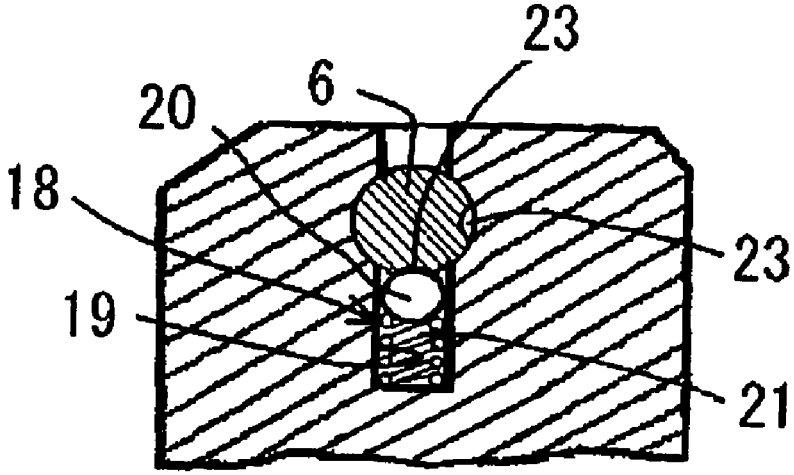
FIG. 1D is an enlarged cross-section of the embodiment shown in FIG. 1C, along line 1D—1D.

On the other hand, referring to FIG. 1D, a pressing device comprising pressing member 18, which comprises ball 20 and spring 21 pressing ball 20 to choke valve shaft 6, is inserted in mounting hole 19 formed in carburetor main body 1 and positioned orthogonal to choke valve shaft 6. As depicted in FIG. 1D, mounting hole 19 is formed, such that choke valve shaft 6 retains ball 20 and spring 21 within mounting hole 19. Pressing member 18 comprises these elements. Peripheral groove 23 is formed in choke valve shaft 6, and a portion of ball 20 is fitted in linear contact with groove 23. Further, choke valve lever 9 comprises pin 10 which protrudes from choke valve lever 9 and is perpendicular to the lever's surface. Throttle valve lever 13 comprises arm piece 14, which protrudes from throttle valve lever 13 on that lever's surface; cam 15, which is formed in an outer edge thereof, and post 16, which connects to an accelerator wire mounted thereto.

When the engine stops, generally, choke valve 5 is fully opened and the throttle valve 7 is at the idle position. When fully closing choke valve 5 from this condition, pin 10 pushes arm piece 14 to rotate throttle valve lever 13 and sets throttle valve 7 at a start position which is slightly open from the idle position. This condition is shown in FIG. 2. Pressing member 18 overcomes the spring force of the return spring 12 to fix choke valve shaft 6 even after manual release of knob 11. When the engine is fired by executing a engine cranking under the condition shown in FIG. 2, throttle valve 7 is returned to the idle position following the opening of choke valve 5 by bringing arm piece 14 into contact with pin 10 due to the spring force of valve closing spring 17 by holding knob 11 and opening choke valve 5 to about an half-open position. This achieves the condition shown in FIG. 3, whereby a warm-up operation and an idling operation are executed. In this condition, even if pin 10 separates from arm piece 14 by fully opening choke valve 5 when the engine is completely fired, throttle valve 7 maintains the idle position.

Figure 3:
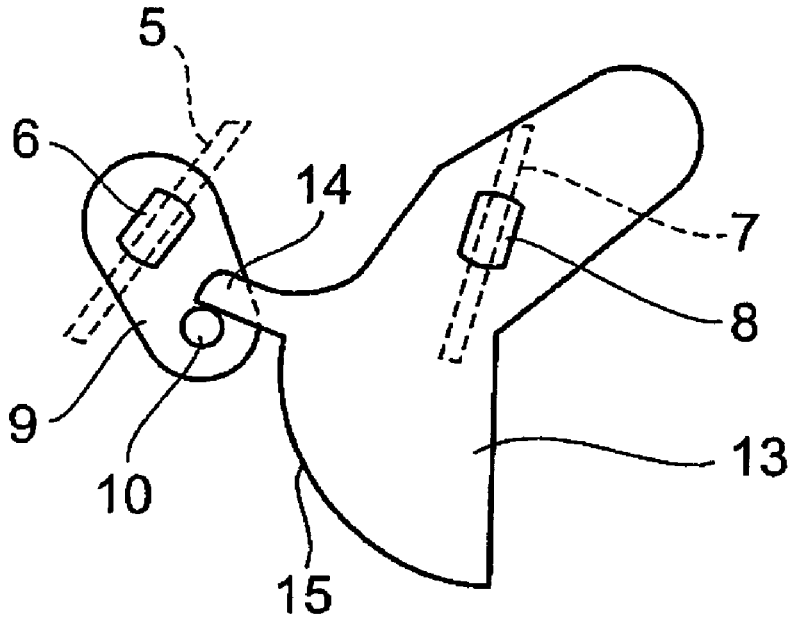
FIG. 3 is a front view of a link mechanism after a complete firing.

When, as shown in FIG. 3, throttle valve 7 is opened from the idle position by the accelerator operation for executing general operation of the engine, arm piece 14 separates from pin 10 and cam 15 approaches pin 10. During this time, because the fixing force generated by spring 21 of pressing member 18 overcomes the rotating force of return spring 12, choke valve shaft 6 fixes choke valve 5 to the half-open position, as shown in FIG. 3. When throttle valve lever 13 further rotates and cam 15 is in contact with pin 10, cam 15 pushes pin 10 to rotate choke valve lever 9, whereby choke valve 5 is opened substantially from the half-open position. As described above, because choke valve 5 is opened while working with throttle valve 7, the intake air amount is fired to correspond with the opening degree of throttle valve 7. Further, when closing throttle valve 7 in the middle thereof, pressing member 18 overcomes the spring force of return spring 12. Accordingly, choke valve 5 is fixed to a position when throttle valve 7 is rotated in reverse.

Figure 4:
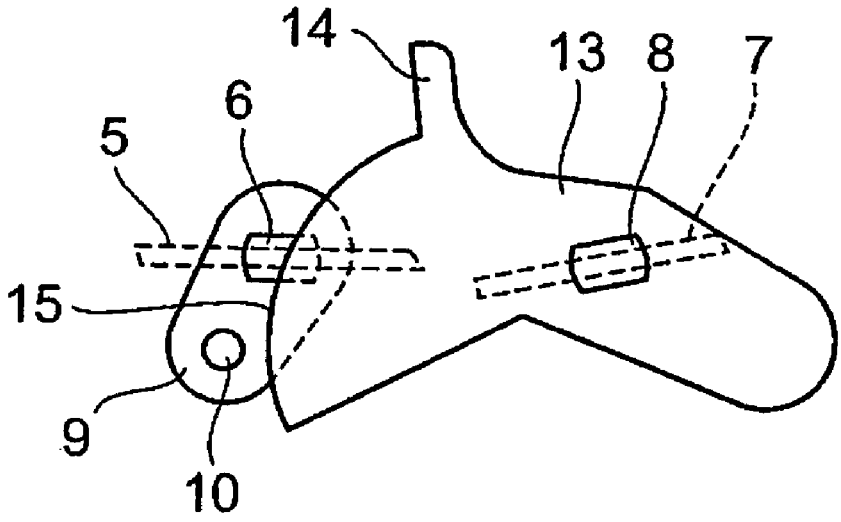
FIG. 4 is a front view of the link mechanism approaching a fully open position of a choke valve.
Figure 5:
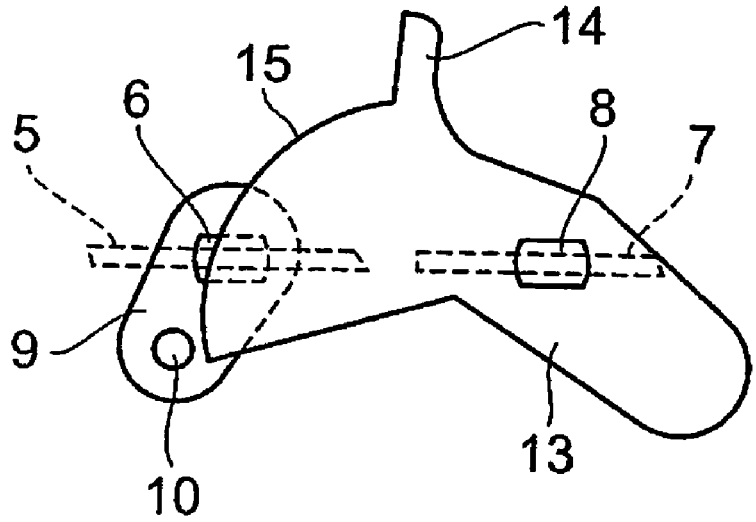
FIG. 5 is a front view of the link mechanism when the choke valve and a throttle valve are fully opened.

When throttle valve 7 is opened substantially toward the full open position, pin 10 is pushed by cam 15, whereby choke valve 5 is opened substantially toward the full open position. In accordance with the present embodiment, peripheral groove 23 is deeply formed toward the pressing member from the area in which choke valve 5 approaches the full open position, and spring 21 is extended so as to lower the spring force. Accordingly, when choke valve 5 is opened, for example, to an opening degree which is less than about ten (10) degrees from the full open position, the rotating force generated by return spring 12 overcomes the securing force of pressing member 18, and choke valve 5 is set to the full open position all at once, and pin 10 separates from cam 15. This condition is shown in FIG. 4. Further, throttle valve 7 reaches the full open position shown in FIG. 5 due to the rotation of throttle valve lever 13 without interference from pin 10. Thereafter, choke valve 5 is fixed to the fully open position due to the spring force of return spring 12, and throttle valve 7 may be opened and closed without pin 10 of choke valve lever 9, arm piece 14 of throttle valve lever 12, and cam 15 interfering with each other.

In accordance with the present embodiment, the starting operation and the subsequent operation may be executed securely and with stability even after manual release of choke valve 5, by an uncomplicated structure. This structure comprises pressing member 18 which applies a securing force to choke valve 5, return spring 12 which applies the opening force, and the link mechanism comprising choke valve lever 9 comprising pin 10 and throttle valve lever 13 comprising arm piece 14 and cam 15, except when choke valve 5 is set to the fully close position and throttle valve 7 is set to the start opening degree, and when choke valve 5 is set to the half-open position and throttle valve 7 is returned to the idle position.

Although preferred embodiments of the present invention have been described in detail herein, the scope of the invention is not limited thereto. It will be appreciated by those of ordinary skill in the relevant art that various modifications may be made without departing from the scope of the invention. Accordingly, the embodiments disclosed herein are only exemplary. It is to be understood that the scope of the invention is not to be limited thereby, but is to be determined by the claims which follow.

What is claimed is:

1. A carburetor comprising a manual choke mechanism comprising a return spring adapted to open a fixed choke valve, a pressing device adapted to fix said choke valve, a valve closing spring adapted to close a throttle valve, and a choke valve lever secured to a choke valve shaft and a throttle valve lever secured to a throttle valve shaft:

wherein said return spring and said pressing device are structured, such that said return spring overcomes a fixing force of said pressing device so as to open said choke valve from a position proximate to a fully open position to the fully open position, and said pressing device overcomes a spring force of said return spring so as to fix the choke valve at another position, and wherein said choke valve lever and the throttle valve lever are structured, such that said throttle valve is set to a position slightly open from an idle position when said choke valve is fully closed, said throttle valve is set to the idle position due to the spring force of said valve closing spring when said choke valve is opened from a fully closed position, said choke valve is opened from a half-open state proximate to the fully open position when said throttle valve is opened from the idle position to the fully open position, and the opening and closing of said throttle valve occurs without mutual interference when said choke valve is fully opened.

2. The carburetor of claim 1, wherein said pressing device comprises a pressing member and a spring which are positioned orthogonal to said choke valve shaft, and said pressing member is retained in a peripheral groove formed in said choke valve shaft by said spring to apply a fixing force to said choke valve shaft.

3. The carburetor of claim 1, wherein said choke valve lever comprises a pin which protrudes from said choke valve lever, said throttle valve lever comprises an arm piece and a cam, said pin pushes said arm piece to slightly open said throttle valve from the idle position when said choke valve is set to the fully closed position, and said pin is pushed by said cam to open said choke valve toward the fully open position when said choke valve is half open so as to open said throttle valve, and said pin separates from said cam when said return spring overcomes the fixing force of said pressing device proximate to the fully open position of the choke valve.

* * * * *